US009947247B2

(12) United States Patent
Milbrandt et al.

(10) Patent No.: US 9,947,247 B2
(45) Date of Patent: Apr. 17, 2018

(54) PERFORATED BIB TIE ARTICLES AND METHODS OF MANUFACTURE AND USE

(71) Applicant: Bedford Industries, Inc., Worthington, MN (US)

(72) Inventors: Jay Milbrandt, Worthington, MN (US); Colin O'Donnell, Worthington, MN (US); Joshua Platt, Bigelow, MN (US); David Schiller, Sioux Falls, SD (US); Axel Wass, Brewster, MN (US); Michael Schultz, Worthington, MN (US); Jeffrey Tschetter, Sioux Falls, SD (US); Terry Langland, Worthington, MN (US)

(73) Assignee: BEDFORD INDUSTRIES, INC., Worthington, MN (US)

( * ) Notice: Subject to any disclaimer, the term of this patent is extended or adjusted under 35 U.S.C. 154(b) by 0 days.

(21) Appl. No.: 15/519,179

(22) PCT Filed: Oct. 16, 2015

(86) PCT No.: PCT/US2015/056038
§ 371 (c)(1),
(2) Date: Apr. 14, 2017

(87) PCT Pub. No.: WO2016/061515
PCT Pub. Date: Apr. 21, 2016

(65) Prior Publication Data

US 2017/0236455 A1 Aug. 17, 2017

Related U.S. Application Data

(60) Provisional application No. 62/065,406, filed on Oct. 17, 2014.

(51) Int. Cl.
*G09F 3/14* (2006.01)

(52) U.S. Cl.
CPC ..... *G09F 3/14* (2013.01)

(58) Field of Classification Search
CPC ..... G09F 3/14
See application file for complete search history.

(56) References Cited

U.S. PATENT DOCUMENTS 3,290,854 A * 12/1966 McMurray ..... B65D 63/10 24/30.5 T
3,370,328 A * 2/1968 Hilton ..... B31D 1/0025 156/176

(Continued)

OTHER PUBLICATIONS

International Search Report, dated Jan. 11, 2016, for International Application No. PCT/US2015/056038, filed on Oct. 16, 2015.

(Continued)

*Primary Examiner* — Gary C Hoge
(74) *Attorney, Agent, or Firm* — Mai-Tram D. Lauer; Westman Champlin & Koehler, P.A

(57) ABSTRACT

A labelling tie (10) includes a tie portion (14), a wire assembly (24), and a bib portion (16) connected to the tie portion. The tie portion (10) has a first arm (18-R), a mid-segment, and a second arm (18-L). Spaced apart perforations (20) intersect each of the first and second arms. The wire assembly (24) has a retention wire (26) that spans across the first arm, the mid-segment, and the second arm. A sheet of labelling ties (62) includes separably connected labelling ties. A method attaches a labelling tie to an item or a group of items. The method includes wrapping the first arm (18-R) and second arm (18-L) around at least one object (12, 12'), allowing the first and second arms to meet at a location with a portion of the first arm and a portion of the second arm extending past the location, and twisting the first and second arm portions together, thereby securing the tie portion around the object(s).

16 Claims, 6 Drawing Sheets

(56) References Cited

U.S. PATENT DOCUMENTS

| | | | | |
|---|---|---|---|---|
| 3,426,393 | A * | 2/1969 | Mead | B65D 63/10 24/30.5 T |
| 3,882,573 | A | 5/1975 | Thomas | |
| 4,948,202 | A * | 8/1990 | Helseth | A47F 3/00 211/45 |
| 5,232,431 | A * | 8/1993 | Helseth | A47F 3/00 24/30.5 T |
| 5,732,495 | A * | 3/1998 | Lowe | G09F 3/14 24/30.5 T |
| 6,372,068 | B1 | 4/2002 | Kincel | |
| 6,673,413 | B1 | 1/2004 | Kincel | |
| 7,011,879 | B1 | 3/2006 | Contreras | |
| 2014/0217718 | A1 | 8/2014 | O'Donnell | |

OTHER PUBLICATIONS

Written Opinion of the International Search Authority dated Jan. 11, 2016, for International Application No. PCT/US2015/056038, filed on Oct. 16, 2015.

* cited by examiner

PERFORATED BIB TIE ARTICLES AND METHODS OF MANUFACTURE AND USE

BACKGROUND

The present disclosure is directed to articles for banding and tagging merchandise, and more particularly to bib ties bearing printed information formed with retention wires for banding merchandise.

Merchandise of many different types is banded in one way or another for packaging or preparing the merchandise for movement in channels toward the ultimate presentation and marketing to the consumer. For example, a twist tie may be placed about the mouth of a bag or about a box of merchandise or about multiple bags or boxes. The twist tie may also be placed directly about the merchandise itself, such as about a grouping of agricultural produce or about a single item of merchandise (e.g., a rolled or folded newspaper).

Labeling or marking of merchandise with printed matter is also often desirable to provide information to various entities in the production and marketing channels as well as to the ultimate consumer. The printed matter may provide information regarding merchandise identification and price and may take the form of, for example, machine readable or scannable material (such as codes comprised of bars or characters) and human readable material (such as characters and graphical or pictorial matter).

SUMMARY

In one aspect, this disclosure describes a labelling tie comprising a tie portion, a wire assembly, and a bib portion connected to the tie portion. The tie portion has a first arm having a first edge extending lengthwise along the first arm, a mid-segment, and a second arm having a second edge extending lengthwise along the second arm. A plurality of spaced apart perforations intersects each of the first and second edges. The wire assembly has a retention wire that spans across the first arm, the mid-segment, and the second arm.

In another aspect, this disclosure describes a sheet of labelling ties comprising a plurality of separably connected labelling ties. Each labelling tie comprises a tie portion, a wire assembly, and a bib portion that is integrally formed with the tie portion. The tie portion has a first arm having a first edge extending lengthwise along the first arm, a mid-segment, and a second arm having a second edge extending lengthwise along the second arm. The arms include spaced apart perforations intersecting each of the first and second edges. The wire assembly has a retention wire spanning across the first arm, the mid-segment, and the second arm.

In another aspect, this disclosure describes a method that attaches a labelling tie to an item or a group of items. The labelling tie comprises a tie portion, a wire assembly, and a bib portion connected to the tie portion. The tie portion includes a first arm having a first edge extending lengthwise along the first arm, a mid-segment, and a second arm having a second edge extending lengthwise along the second arm. A plurality of spaced apart perforations intersects each of the first and second edges thereby defining arm segments. The wire assembly comprises a retention wire spanning across the first arm, the mid-segment, and the second arm. The method comprises wrapping the first arm around a first side of at least one object and wrapping the second arm around a second side of the at least one object, disposing the first arm and the second arm to meet at a location with a portion of the first arm and a portion of the second arm extending past the location, and twisting the first arm portion and the second arm portion together, thereby securing the tie portion, and thus the bib portion, around the object(s).

This disclosure in its various combinations, either in apparatus or method form, may also be characterized by the following listing of items:

1. A labelling tie, comprising:
   - a tie portion comprising:
     - a first arm having a first edge extending lengthwise along the first arm;
     - a mid-segment; and
     - a second arm having a second edge extending lengthwise along the second arm;
     - wherein a plurality of spaced apart perforations intersects each of the first and second edges;
   - a wire assembly comprising:
     - a retention wire, wherein the retention wire spans across the first arm, the mid-segment, and the second arm; and
   - a bib portion connected to the tie portion.
2. The labelling tie of item 1, wherein the bib portion is integrally formed with the mid-segment.
3. The labelling tie of any of items 1-2, wherein the first arm and the second arm extend in opposing directions from the mid-segment.
4. The labelling tie of any of items 1-3, wherein the plurality of perforations are positioned proximate distal ends of the respective first and second arms.
5. The labelling tie of any of items 1-4, wherein at least one of the plurality of perforations is cut substantially perpendicularly to the retention wire.
6. The labelling tie of any of items 1-5, wherein at least one of the plurality of perforations on each of the first and second arms is configured to separate when the first and second arms are twisted together;
   - wherein the plurality of perforations define a plurality of first arm segments on the first arm and a plurality of second arm segments on the second arm; and
   - wherein at least a first arm segment and at least a second arm segment are configured to interlock to secure the arms together.
7. The labelling tie of any of items 1-6, further comprising printed indicia provided on the bib portion.
8. The labelling tie of any of items 1-7, wherein the wire assembly further comprises a sleeve that encases the retention wire.
9. The labelling tie of any of items 1-8, further comprising an adhesive layer disposed between the wire assembly and the tie portion.
10. The labelling tie of any of items 1-9, wherein the tie portion and the wire assembly are secured through heat bonding.
11. A sheet of labelling ties, comprising:
    - a plurality of separably connected labelling ties, wherein each labelling tie comprises:
      - a tie portion including a first arm having a first edge extending lengthwise along the first arm, a mid-segment, and a second arm having a second edge extending lengthwise along the second arm, and
        - wherein the arms include spaced apart perforations intersecting each of the first and second edges;
    - a wire assembly comprising:
      - a retention wire, wherein the retention wire spans across the first arm, the mid-segment, and the second arm; and
    - a bib portion integrally formed with the tie portion.

12. The sheet of item 11 wherein at least two of the plurality of labelling ties are laid out such that their respective tie portions are arranged longitudinally along a line to form a first row of labelling ties.
13. The sheet of item 12 further comprising at least a second row of labelling ties;
    wherein the second row of labelling ties is arranged such that a bib portion of the second row is disposed between two adjacent bib portions of the first row;
    wherein each bib portion of the second row is oriented to be upside-down relative to each bib portion of the first row; and
    wherein the first and second rows of labelling ties form a first pair of rows.
14. The sheet of item 13 further comprising at least a second pair of rows disposed to lie parallel to the first pair.
15. A method of using a labelling tie, the labelling tie comprising:
    a tie portion including a first arm having a first edge extending lengthwise along the first arm, a mid-segment, and a second arm having a second edge extending lengthwise along the second arm, and
        wherein a plurality of spaced apart perforations intersects each of the first and second edges thereby defining arm segments;
    a wire assembly comprising:
        a retention wire, wherein the retention wire spans across the first arm, the mid-segment, and the second arm; and
    a bib portion connected to the tie portion;
    the method comprising:
    wrapping the first arm around a first side of at least one object;
    wrapping the second arm around a second side of the at least one object such that the first arm and the second arm meet at a location, wherein a portion of the first arm and a portion of the second arm extend past the location; and
    twisting the first arm portion and second arm portion together such that the tie portion and thus the bib portion are secured about the at least one object.
16. The method of item 15 wherein twisting the first and second arm portions together comprises:
    interlocking at least one of the first arm segments with at least one of the second arm segments to further secure the tie portion about the at least one object.

DEFINITIONS

Unless otherwise specified, the following terms as used herein have the meanings provided below:

The terms "about" and "substantially" are used herein with respect to measurable values and ranges due to expected variations known to those skilled in the art (e.g., limitations and variabilities in measurements).

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure is directed to tie articles, such as labelling ties or bib ties, that may be manufactured in a continuous, in-line process, which reduces manufacturing costs and time, and which desirably produces tie articles with good durability. As discussed below, an exemplary bib tie of the present disclosure includes a bib portion and a tie or attachment portion, where the tie portion includes multiple perforations to assist in locking the ends of the tie portion together when twisted around an item. The perforated tie portion provides a greater holding force to help prevent the twist in the tie portion from loosening and coming apart. The tie portion is also preferably wide relative to standard ties to give the impression of being better able to hold an item or bundle of items together, as well as providing more printable surface area along the entire length of the tie portion.

The bib tie of the present disclosure may be used in a variety of industrial, commercial, and residential applications. For instance, the tie or attachment portion may be used to attach the bib tie to an item, to bundle items together (e.g., agricultural produce, closable packages, cables, writing utensils, eating utensils, and the like), and/or to hold packages or articles closed (e.g., hold bread bags closed or hold rolled papers closed).

Figure 1A:
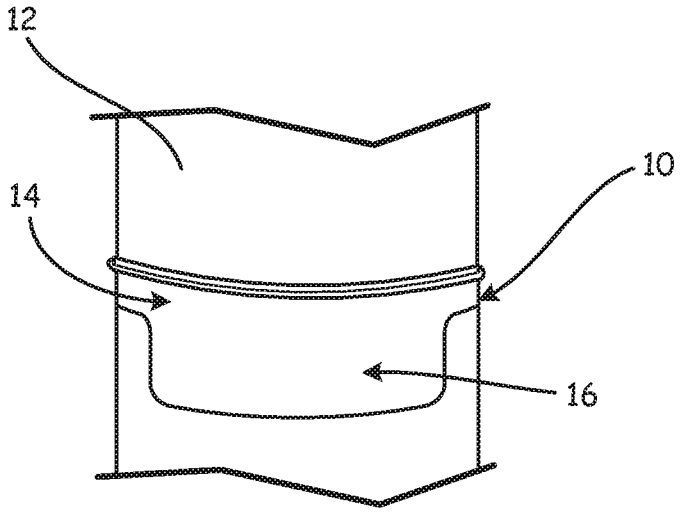
FIG. 1A is a front perspective view of a bib tie of the present disclosure attached to an item.

Once the tie portion is attached to the item, the bib portion may then prominently display information, such as textual, graphical, colored, or machine readable information (e.g., bar codes, quick response codes, radio frequency identification (RFID) tags, internet addresses) about the attached or bundled items. For example, FIG. 1A illustrates bib tie 10 in use with item 12, where bib tie 10 includes tie portion 14 and bib portion 16. As shown, tie portion 14 is secured around item 12 to secure bib tie 10 to item 12. Bib tie 10 may alternatively be used to bundle multiple items together. For instance, as shown in FIG. 1B, bib tie 10 may bundle multiple cables or other items 12' together.

Figure 1B:
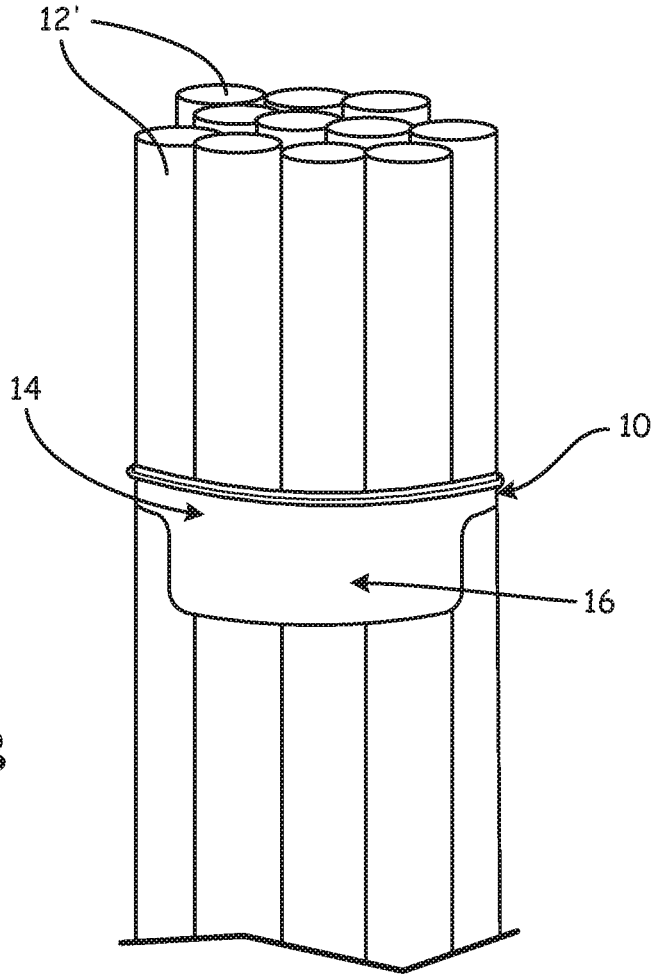
FIG. 1B is a front perspective view of a bib tie of the present disclosure attached to a bundled group of items.

When attached to a single item 12 (e.g., as shown in FIG. 1A) or multiple items 12' (e.g., as shown in FIG. 1B), bib portion 16 is suspended from tie portion 14, and may include scannable, readable or otherwise viewable information about item(s) 12, 12', such as the produce type, UPC codes, brand information, storage and use instructions, producer information, and the like. Thus, bib tie 10 provides a convenient and effective mechanism for prominently displaying information about item(s) 12, and/or for bundling multiple items 12 or other items together. Furthermore, as discussed below, tie portion 14 and bib portion 16 may be integrally formed together in a continuous, in-line manufacturing process, which preferably produces multiple bib ties 10 in sheet and/or roll form.

As further shown in FIGS. 1C-4, tie portion 14 includes right and left arms 18-R and 18-L, each having multiple perforations 20. Each of arms 18-R and 18-L is wrapped around opposite sides of one or more items until arms 18-R, 18-L meet, thereby encircling the item(s). Portions of arms 18-R, 18-L extend past the point at which arms 18-R, 18-L meet and are twisted together in a tied knot or helix (referred to as helix 66, and discussed further below). When securing bib tie 10 to one or more items 12, 12' the perforations 20 proximate the ends of arms 18-R and 18-L split apart as arms 18-R and 18-L are twisted and become intertwined or entangled, thereby securing the twist or helix 66 together and preventing arms 18-R and 18-L from unwrapping. Perforations 20 also provide a visible perception of good entanglement because perforations 20 split apart when arms 18-R and 18-L are tied together. and the perforated segments 41 wrap up around the tie location, such that the twist or helix 66 is strong and resistant to loosening and coming apart.

Figure 2:
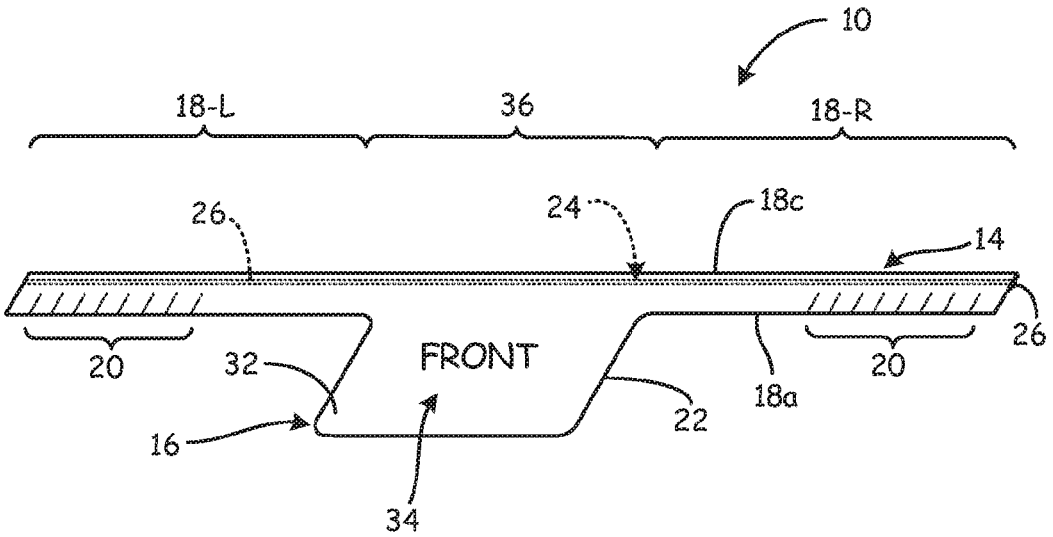
FIG. 2 is a top perspective view of an exemplary bib tie.
Figure 3:
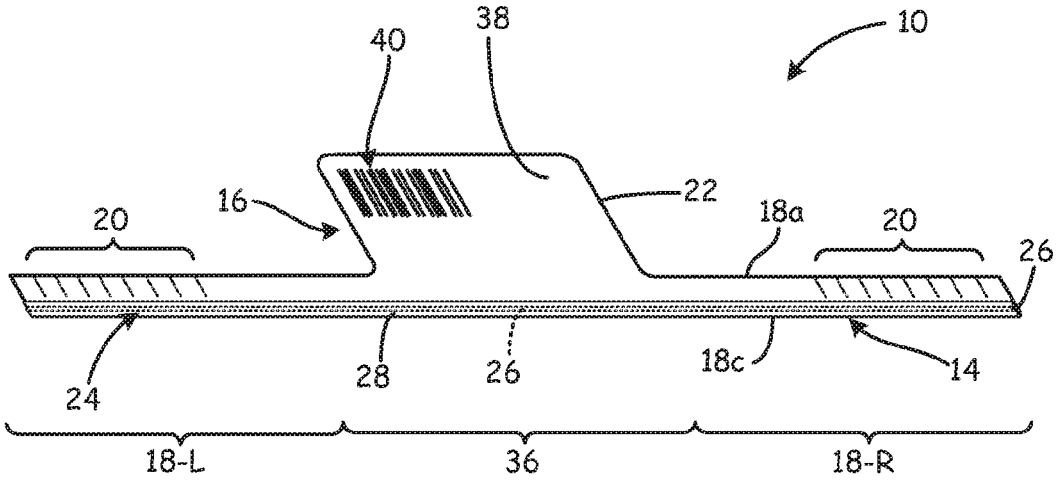
FIG. 3 is a bottom perspective view of an exemplary bib tie.
Figure 4:
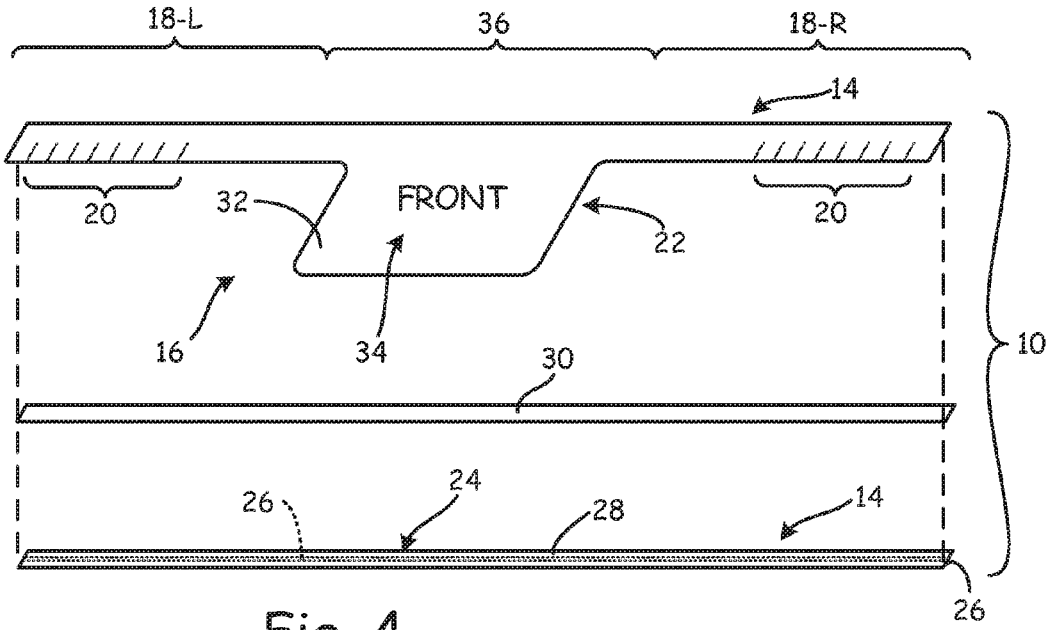
FIG. 4 is an exploded top perspective view of an exemplary bib tie.

FIGS. 2-4 illustrate an example embodiment for bib tie 10 in a flat configuration. As shown in FIG. 2, prior to being secured to an item (e.g., item(s) 12, 12'), tie portion 14 may be provided in a flat, non-bent state (as shown) or in a partially-bent state (e.g., if provided in a roll form with sequential bib ties connected arm-to-arm). As further shown, tie portion 14 integrally extends into bib portion 16, where tie portion 14 and bib portion 16 structurally include sheet 22 that extends across bib portion 16 and tie portion 14, and includes perforations 20 at arms 18-R and 18-L. Tie portion 14 also includes wire assembly 24 (having retention wire 26 encased in, for example, a polymeric and/or paper-based sleeve 28).

Sheet 22 and wire assembly 24 are preferably secured together at tie portion 14, such as with adhesive layer 30 (shown in FIG. 4), thereby disposing retention wire 26 to span across tie portion 14. As such, tie portion 14 may function as a twist tie or other attachment mechanism to secure bib tie 10 to item(s) 12, 12', to bundle multiple items 12' together, and/or to hold packages or other articles closed.

Sheet 22 is desirably produced from a printable material, such as one or more paper-based materials and/or polymeric materials to present information (e.g., textual, graphical, colored, and/or machine readable information), such as high quality flexographic or digital prints. As discussed below, when manufacturing bib tie 10, sheet 22 is desirably provided as a pre-formed and pre-printed sheet that may be fed into a continuous, in-line process. In the example shown, sheet 22 includes a front surface 32, which allows information such as indicia 34 to be presented on front surface 32. Sheet 22 may also optionally include a clear polymeric film that covers front surface 32, thereby protecting front surface 32 and structurally reinforcing bib tie 10.

As mentioned above, wire assembly 24 includes retention wire 26 and sleeve 28. Retention wire 26 is a metallic or polymeric wire that desirably provides good dead-fold properties, as well as good break resistance. For example, in one embodiment, retention wire 26 is a metallic-wire core of a twist tie (e.g., a steel wire). However, metal-wire twist ties may be undesirable for use in some applications. For example, when food is commercially packaged for distribution to the public, it is desirable for the packaging to allow inspection of packaged food for contamination by foreign objects. One common method of inspecting food products involves the use of metal detectors to confirm that no metal scrap or shards have inadvertently been incorporated in the food product during production or packaging.

Tie articles with metal retention wires, when attached to food articles, preclude such use of a metal detector, since each food article that is attached to the tie article would typically generate a response by the metal detector indicating the presence of metal in the food package. Thus, rather than simply detecting the presence of any undesired metal in the packaged food, the metal detector would also indicate, for each package, the presence of the metal wire retention wire on the tie article.

Accordingly, in other embodiments, retention wire 26 is a polymeric wire, such as a single component wire or a multiple component wire. Suitable polymeric materials for retention wire 18 include polyethylenes (e.g., high-density polyethylenes), and those disclosed in U.S. Pat. Nos. 6,372,068, 6,673,413 and 7,011,879. In embodiments in which the polymer material is a high-density polyethylene, the high-density polyethylene desirably has a density of at least about 0.94 grams/cubic-centimeter, as measured pursuant to ASTM D792-08.

In some embodiments, the material of retention wire 26 may also include additional additives, such as colorants, fillers, dead-fold modifiers, biodegradable additives (e.g., oxo-biodegradable additives), toughness modifiers, bond promoters, ultraviolet-stabilizers, and the like. In these embodiments, examples of suitable concentrations of additives in the material range from about 0.01% by weight to about 10% by weight, based on an entire weight of the material. In one embodiment, suitable concentrations of the additives in the material range from about 0.05% by weight to about 5% by weight, based on an entire weight of the material. The polymeric materials discussed above accordingly constitute the remainder of the material for retention wire 26.

Sleeve 28 is a polymeric and/or paper-based sleeve that partially or fully encases retention wire 26. Examples of suitable polymeric materials for sleeve 28 include extrudable polymeric materials, such as polyolefins (e.g., low-density polyethylene, high-density polyethylene, and combinations thereof). In some embodiments, sleeve 28 is a polymeric sleeve that fully encases retention wire 26. In other embodiments, sleeve 28 includes a polymeric layer and a paper-based layer bonded to sheet 22 around retention wire 26 to encase retention wire 26 therebetween. Alternatively, sleeve 28 may be a polymeric or paper-based layer bonded to sheet 22, with retention wire 26 disposed between sleeve 28 and sheet 22.

As mentioned above, at tie portion 14, sheet 22 and wire assembly 24 define a pair of arms 18-R and 18-L extending in opposing directions from mid-segment 36. As shown, one or both of sheet 22 and sleeve 28 of wire assembly 24 may include perforations 20 extending therethrough. In some embodiments, perforations 20 only extend through sheet 22 at arms 18-R and 18-L, and sleeve 28 of wire assembly 24 does not include any perforations.

As discussed above, arms 18-R and 18-L with perforations 20 may function as twist-tie arms, which may be manipulated (e.g., bent and twisted) to secure bib tie 10 to item(s). Tie portion 14 extends into bib portion 16 at mid-segment 36, allowing bib portion 16 to be suspended from tie portion 14. In this way, indicia 34 on bib portion 16 are displayed when tie portion 14 is attached or bundled to item(s). A pair of arms 18-R and 18-L is shown, but any number of arms having any orientation relative to bib portion 16 (e.g., extending diagonally from bib portion 16) may be used. For instance, four arms may be arranged such that two extend in each opposing direction from bib portion 16. This alternative embodiment may be useful for securing a larger bib portion 16 or bundle of long items.

Examples of suitable thicknesses for tie portion 14 (outside of the location of retention wire 26) range from about 0.003 inches to about 0.01 inches, where the thickness of sheet 22 may vary depending on the particular materials used. At the location of retention wire 26, the thickness of tie portion 14 is increased to account for the dimensions of retention wire 26. For example, for a retention wire 26 having a diameter or other cross-sectional thickness of about 0.017 inches, examples of suitable thicknesses for tie portion 14 at the location of retention wire 22 range from about 0.02 inches to about 0.03 inches.

Additionally, each arm 18-R and 18-L preferably has a sufficient width (perpendicular to its length) to provide good twist-tie retention and a wide wrap around the item(s) 12, which may be more attractive to an end customer, as discussed below. Examples of suitable widths for each arm 18-R, 18-L range from about 0.25 inches to about 1 inch, more preferably from about 0.3 inches to about 0.75 inches, and even more preferably from about 0.4 inches to about 0.6 inches. A greater width also provides a larger surface area for printing indicia 34 on arms 18-R and/or 18-L.

As shown in FIG. 3, sheet 22 also includes rear surface 38, which may also include scannable or printed information, such as bar code 40 or other textual, graphical, colored, machine readable information, and/or internet addresses. As further shown, wire assembly 24 is secured to sheet 22 at rear surface 38 along tie portion 14.

FIG. 4 further illustrates the relative arrangements of sheet 22, adhesive layer 30, and wire assembly 24. As can be seen, adhesive layer 30 is disposed between sheet 22 and wire assembly 24 to allow adhesive layer 30 to securely bond wire assembly 24 to rear surface 38 of sheet 22. Accordingly, adhesive layer 30 may include any suitable pressure sensitive or hot melt adhesive to adhere sheet 22 and sleeve 28 of wire assembly 24 together.

In alternative embodiments, adhesive layer 30 may be omitted, and sheet 22 and sleeve 28 may be directly secured together, such as with a heat sealing process. In further alternative embodiments, wire assembly 24 (and adhesive layer 30) may be secured to front surface 34 of sheet 22. This may depend on which side of bib tie 10 the user or manufacturer intends to display when attached to one or more items 12, 12'.

Figure 5A:
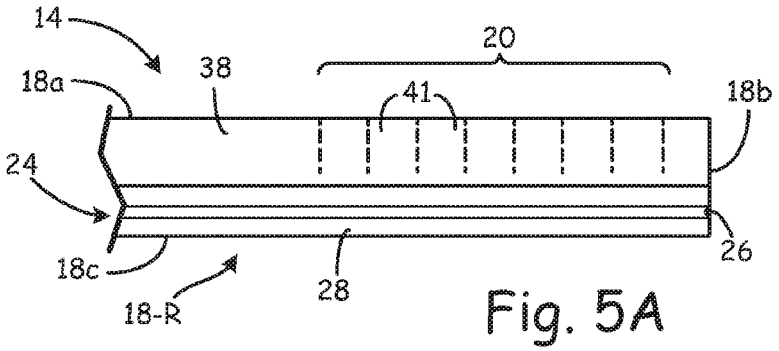
FIG. 5A is an enlarged back view of an arm of the bib tie, illustrating perforations along the arm.

As shown in FIG. 5A, perforations 20 may extend from the leading edge of each of arms 18-R and 18-L (referred to as leading edge 18*a*) proximate a distal end (referred to as distal end 18*b*). In this embodiment, wire assembly 24 may be secured to the trailing portion of tie portion 14, adjacent to the trailing edge of each arm 18-R, 18-L (referred to as trailing edge 18*c*). Leading edge 18*a*, trailing edge 18*c*, and distal end 18*b* are shown on arm 18-R, but it is understood that arm 18-L has a corresponding leading edge, trailing edge, and distal end. The terms "leading" and "trailing" are used herein for ease of reference, and do not represent a direction of motion or preferred orientation of bib tie 10 with respect to a user or item(s).

Each arm 18-R and 18-L may include any suitable number of perforations 20, such as from two to twenty, four to fifteen, and/or six to ten. Furthermore, the spacings between each perforation 20 may be the same, or may vary, as desired. Each pair of perforations 20 separates the arm 18-R and 18-L into segments 41, which may have the same or different lengths, as desired, based on the spacings between the pairs of perforations 20. Examples of suitable spacings between each perforation 20 (i.e., the length of each segment 41) range from about 0.1 inches to about 0.5 inches, and more preferably from about 0.2 inches to about 0.3 inches. In one embodiment, each segment 41 between pairs of perforations 20 is about 0.25 inches in length.

Perforations 20 may be positioned along each arm 18-R and 18-L from distal end 18*b* to any suitable distance toward mid-segment 36. In some embodiments, perforations 20 may be positioned only proximate a distal portion of arm 18-R and 18-L, as shown. In other embodiments, perforations 20 may extend along the entire length of each arm 18-R and 18-L from distal end 18*b* to the intersection with bib portion 16. Examples of suitable distances from distal end 18*b* range from about one inch to about five inches, more preferably from about one inch to about three inches, and in some embodiments, from about 1.5 inches to about 2.5 inches (i.e., about two inches).

Figure 5B:
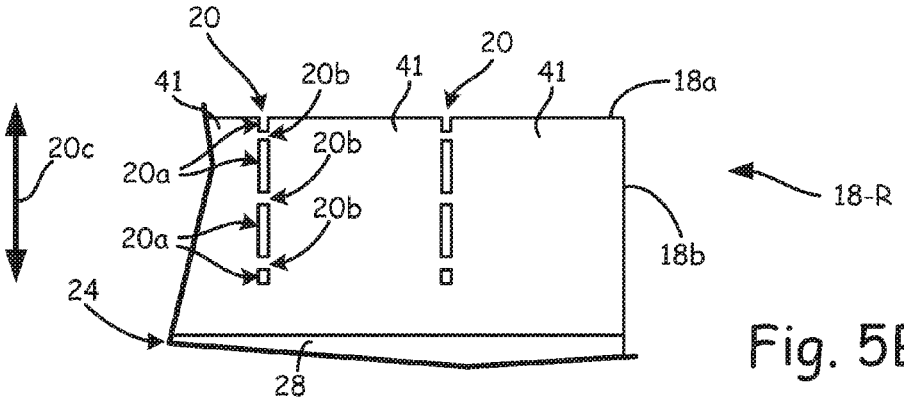
FIG. 5B is a further enlarged back view of an adjacent pair of the perforations along the arm.

As shown in FIG. 5B, each perforation 20 may include multiple slots 20*a* separated by one or more connecting tabs 20*b* of sheet 22. In the shown embodiment, each perforation 20 includes four slots 20*a* separated by three tabs 20*b*. In this case, as shown, one of the slots 20*a* is cut into leading edge 18*a* to assist in separating the given perforation 20.

The lengths of each slot 20*a* and tab 20*b*, as taken along direction 20*c* between leading edge 18*a* and trailing edge 18*c*, may vary as needed to assist in separating each perforation 20. Examples of suitable lengths for each slot 20*a* range from 10 mils to about 100 mils, where some of the slots 20*a* may range from about 10 mils to about 30 mils, and other slots 20*a* may range from about 50 mils to about 80 mils. In the shown example, the shorter slots 20*a* may, for instance, each be about 20 mils in length, and the longer slots 20*a* may, for instance, each be about 70 mils in length.

Each tab 20*b* may also vary as needed to hold each arm 18-R, 18-L together prior to use, but also to allow each perforation to readily separate when needed. Examples of suitable lengths for each tab 20*b* between pairs of slots 20*a* range from about 10 mils to about 20 mils. In the shown example, each tab 20*b* may, for instance, be about 15 mils in length.

In the shown embodiment, perforations 20 extend parallel to each other along direction 20*c*. In alternative embodiments, however, perforations 20 may extend non-parallel to direction 20*c*, as desired. For example, each perforation 20 may extend from leading edge 18*a* at about a 30-degree angle in either direction relative to direction 20*c*. Nonetheless, in a preferred embodiment, perforations 20 are parallel with each other and co-linear with direction 20*c*.

Figure 6A:
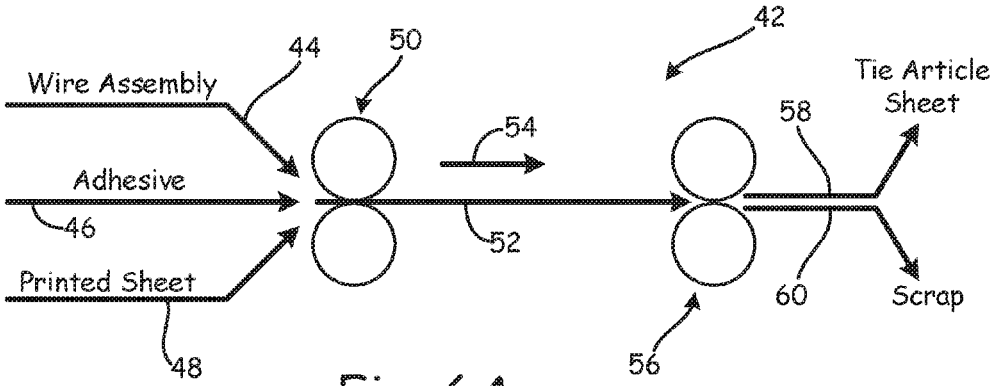
FIG. 6A is a schematic illustration of a process system for manufacturing the bib tie.

FIG. 6A is a schematic illustration of an example process system 42 for manufacturing multiple bib ties 10 in a sheet or roll form using a continuous, in-line process. As shown, process system 42 includes extruded wire assembly inlet line 44, adhesive inlet line 46, and sheet inlet line 48. Wire assembly inlet line 44 is a feed for multiple prefabricated wire assemblies 24.

Alternatively, wire assemblies 24 may be fabricated in situ with the formation of bib ties 10. In this case, wire assembly inlet line 44 may include multiple inlet lines configured to melt, extrude, and/or bond the polymeric and/or paper-based materials for multiple sleeves 28, which encase continuous strands of retention wire 26 fed from supply sources (e.g., spools of retention wires 26 or manufacturing lines for retention wires 26).

Adhesive line 46 is configured to relay multiple webs of the adhesive material for adhesive layer 30, or to melt and extrude the adhesive material. Finally, sheet inlet line 48 is configured to relay webs 52 for sheet 22. Webs 52 may be pre-printed with indicia 34, or indicia 34 may be printed at a later time.

Wire assembly inlet line 44, adhesive line 46, and sheet inlet line 48 desirably converge at nip rollers 50, which may compress and cool the received materials to produce a continuous web 52 of the laminated layers. Web 52 moves in the direction of arrow 54 and is cut at die cutter 56 into the multiple, separable bib ties 10. For example, die cutter 56 may partially cut and/or perforate web 52, allowing web 52 to maintain a continuous sheet of multiple, separable bib ties 10 that can exit process system 42 via exit line 58. Additionally, die cutter 56 may also form perforations 20 in tie portions 14.

Resulting scrap pieces (at regions 64 of FIG. 6B) from web 52 may drop out of process system 42 via scrap line 60, where the scrap pieces may then be collected and recycled. The resulting continuous sheet of bib ties 10 from exit line 58 may then be stacked, folded, rolled into a roll form, or otherwise made available for subsequent consumer use.

Figure 6B:
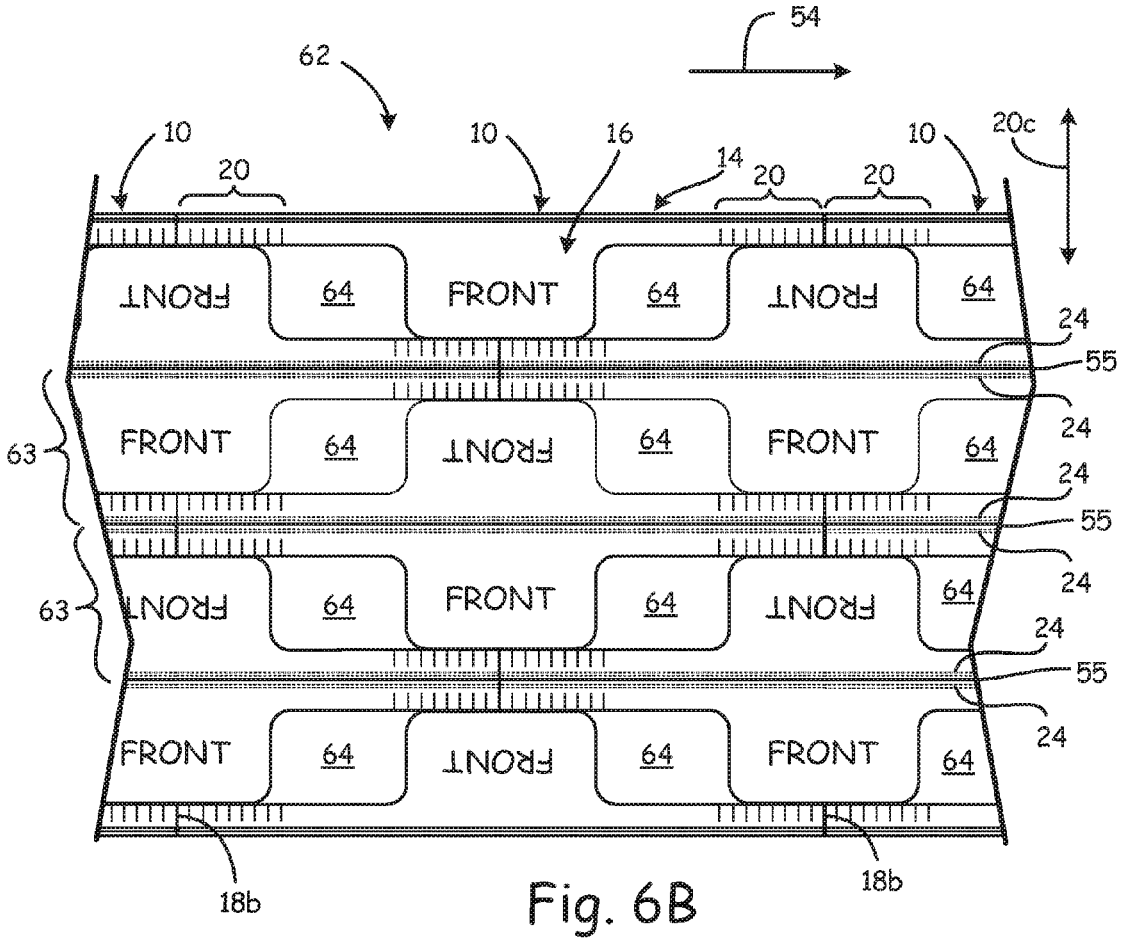
FIG. 6B is a top view of a continuous sheet of multiple bib ties during bib tie production.

FIG. 6B illustrates an example continuous sheet 62 of multiple bib ties 10 after exiting process system 42 via exit line 58. As shown, continuous sheet 62 may include multiple bib ties 10 arranged in a staggered back-to-back arrangement to maximize the number of bib ties 10 per unit area of sheet 62. Multiple bib ties 10 may be arranged so that their tie portions 14, and more particularly wire assemblies 24, are laid out in a first continuous line or row along direction 54. A second continuous line of bib ties 10 may be laid along direction 54 with each bib portion 16 being disposed between two adjacent bib portions 16 of the first line. The bib portions 16 of the second line are oriented upside-down relative to the bib portions 16 of the first line. The first and second continuous lines of bib ties 10 form a pair of bib tie lines or rows 63. Another pair of rows 63 may abut the first pair of rows along line 55 with bib portions 16 lined up in direction 20*c*. Sheet 62 may comprise any number of such pairs 63.

To maintain the sheet-like character of sheet 62, the individual bib ties 10 desirably remain at least partially connected to each other. For example, in some embodiments, the bib ties 10 may be cut around bib portions 16, where the segments of sheet 62 between bib ties 10 (referred to as regions 64) may be fully cut out to provide the scrap at scrap line 60 (shown above in FIG. 6A). Alternatively, regions 64 may remain connected to sheet 62 and be partially separated from the bib portions 16 via perforated lines, allowing regions 64 to be readily separated by consumers when needed.

Furthermore, the ends of the retention wires 26 (or other closure devices) are desirably fully cut at distal ends 18*b* to assist in the ease of separating the individual bib ties 10. A variety of different cut patterns may be used to retain sheet 62 in a sheet-like form, while also allowing each individual bib tie 10 to be separated without requiring undue force or separate cutting utensils. Upon exiting process system 42, sheet 62 may be stacked, folded, rolled into a roll form, or otherwise made available for transporting, storing, and using bib ties 10.

Accordingly, during subsequent consumer use, the consumer may obtain a sheet or roll of sheet 62, separate the desired number of bib ties 10 (manually or with an automated system), and attach each separated bib tie 10 to one or more items with tie portions 14 (again, manually or with an automated system). For example, tie portion 14 of a bib tie 10 may be attached to a single item, and the corresponding bib portion 14 may then display information for the given item.

Alternatively, tie portion 14 may be bound around multiple items to bundle the items together. In this situation, the corresponding bib portion 16 may also display information for the given bundled items. Furthermore, tie portion 14 may be used to hold a package closed, such as bread bag twist tie, where the corresponding bib portion 16 may display information for the given package or goods within the package. Additionally, tie portion 14 may be used to hold an article closed, such as rolled paper (e.g., a rolled map), where the corresponding bib portion 16 may display information for the given article.

Figure 1C:
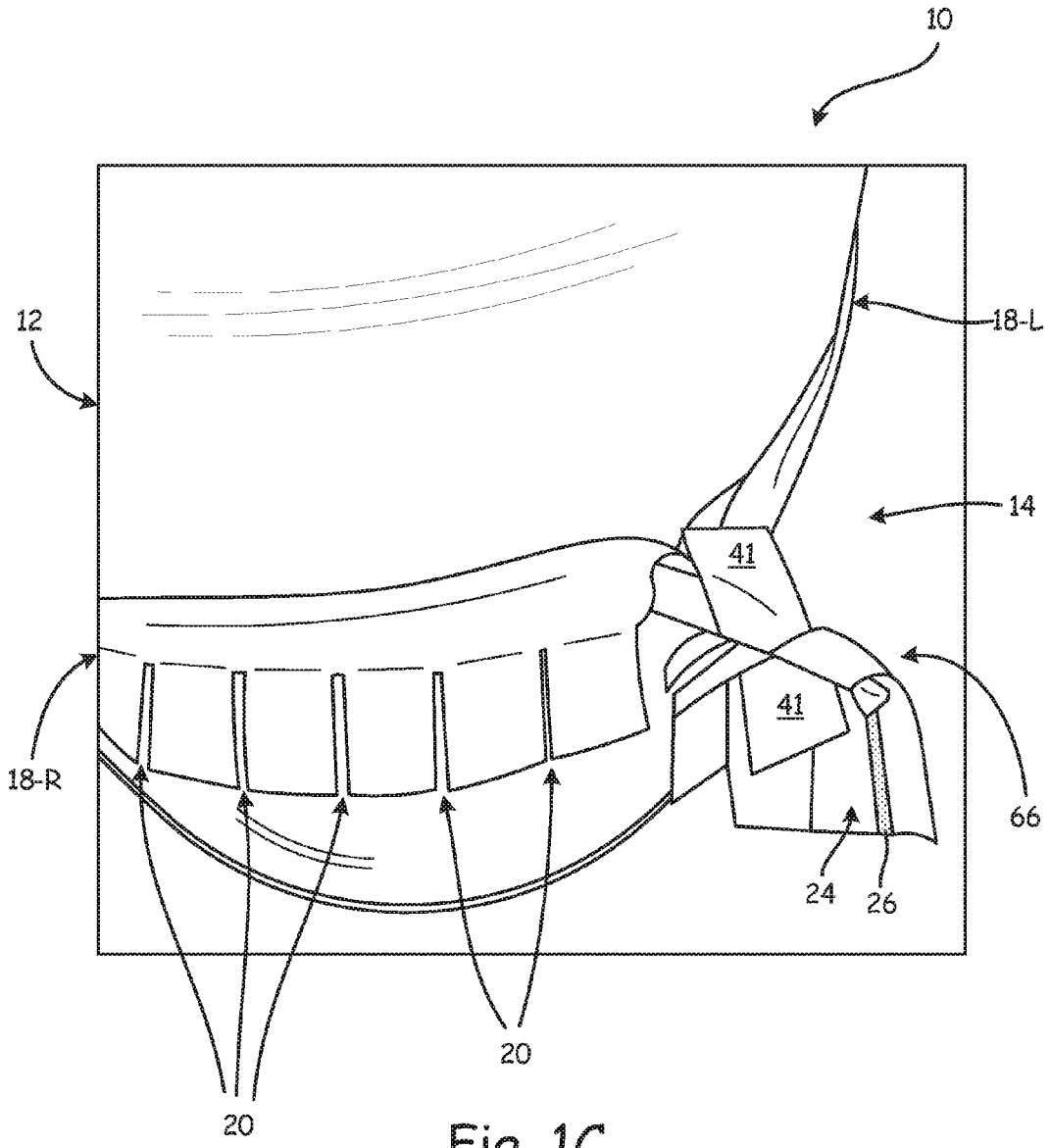
FIG. 1C is a side perspective view of the bib tie attached to an item.
Figure 7:
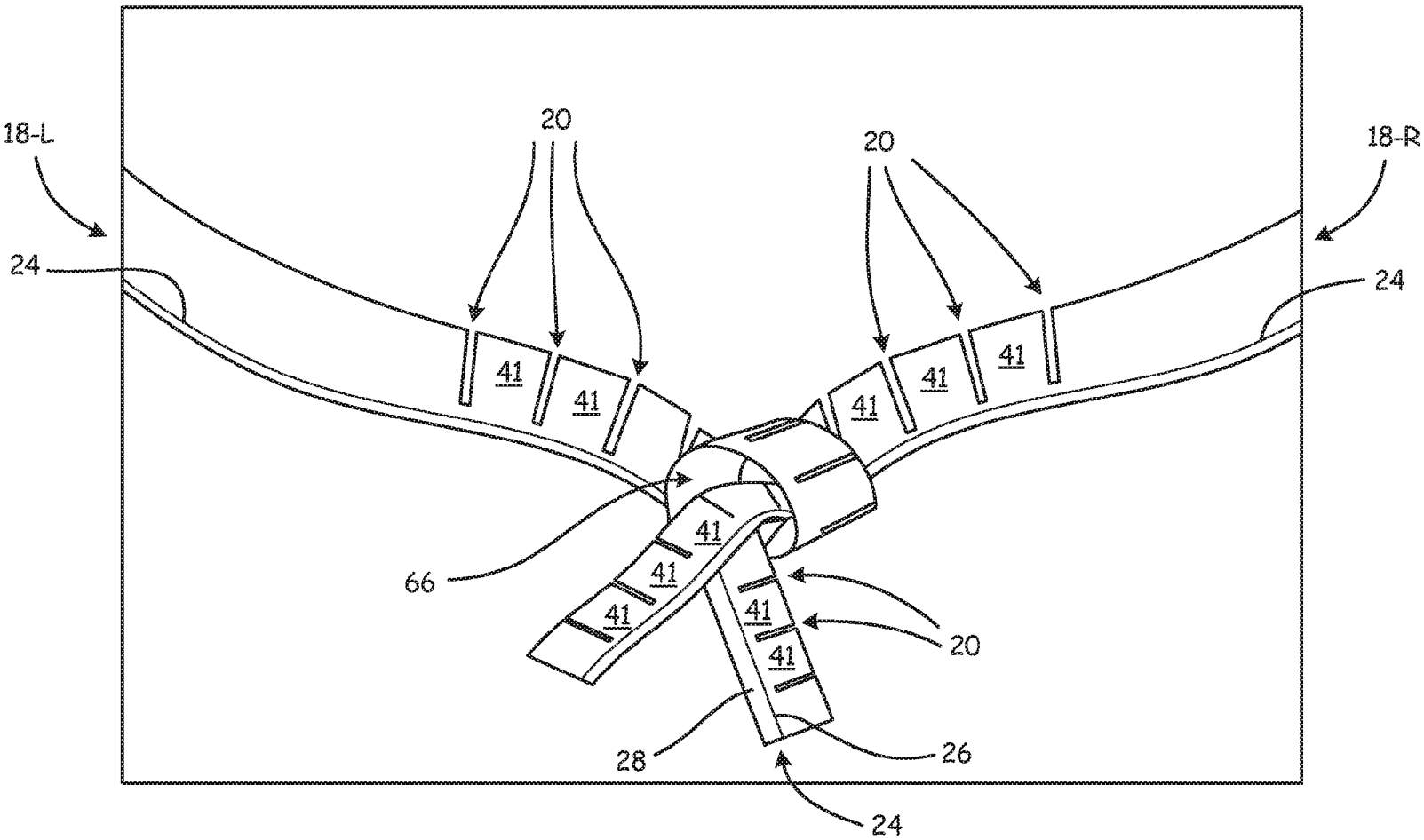
FIG. 7 is a perspective view of the bib tie shown in FIG. 1C removed from the item and being tied into a helix or knot.

FIG. 7 illustrates the tie engagement between arms 18-R and 18-L. Arms 18-R and 18-L are shown in a loose twist or knot to better illustrate the structure of helix 66. During use, the twist may be tightened, as shown in FIG. 1C. As discussed above, the use of a relatively wide tie portion 14 (e.g., about 0.5 inches in width along direction 20*c*) can be more attractive to an end customer. For instance, it may provide better cushion so that the items that are bundled with bib tie 10 are held securely, but with less potential for squeezing damage. It has been found that arms with widths less than about 0.25 inches are perceived as being damaging to more fragile products, because they are so narrow that they can potentially dig into the fragile products while being tied together. Additionally, a wide tie portion 14 can provide a more aesthetically pleasing and larger surface area for printing on arms 18-R and/or 18-L of each bib tie 10.

However, the use of the wider arms without perforations can present an issue when twisting arms together to entangle them. In particular, the wider sheet material can get twisted up with retention wire 26 when arms 18-R, 18-L are tied together. This can cause the initial twisting to be more difficult, as more material has to be deformed when twisting. Furthermore, the resulting helix that is formed after twisting is weaker, since the helix ends up larger when all the wider material is twisted along with the retention wire. A larger helix has been shown to result in a weaker twist, and resultingly, a weaker bundle.

Accordingly, the inclusion of perforations 20 in the wider material of arms 18-R and 18-L alleviates this issue, as perforations 20 allow the sheet material to remain largely outside of the helix 66, as shown in FIG. 1C. Additionally, perforations 20 have also been shown to help resist un-twisting of the helix 66. When observing a tie helix 66 under load and beginning to untwist, one can see that perforations 20 and the resulting edges between segments 41 (formed by the separated perforations 20) engage with each other to inhibit the un-twisting of the helix 66.

As shown in FIG. 1C, when helix 66 is formed, at least two segments 41 are separated due to the broken perforations 20, and become interlocked. If this helix 66 were to begin un-twisting, the edges of these separate segments 41 would contact and need to be deformed, adding to the force necessary to untwist arms 18-R and 18-L. In fact, it has been found that arms with perforations 20 exhibit greater results in twist strength pull tests compared to arms of the same size without the perforations 20.

Moreover, perforations 20 provide tangible feedback to a user twisting arms 18-R and 18-L together. When a user first twists arms 18-R and 18-L together, perforations 20 break, and the user can feel these perforations 20 breaking or "cracking." This provides the perception that the bundled item(s) are securely fastened by bib tie 10.

In the above-discussed embodiment, bib tie 10 includes a substantially rectangular geometry. However, the bib ties of the present disclosure may have bib portions with any desired geometry, such as a half-circle geometry, a trapezoidal geometry, a geometry with a necked-down region, and/or any other suitable geometry. The particular geometry for bib portion 16 may be generated with die cutter 56 of process system 42 (shown above in FIG. 6A), where the cutout regions 64 of sheet 62 (shown in FIG. 6B) will have geometries that are reciprocal matches to the geometries of bib portions 16. As can be appreciated, the use of cutout regions 64 in this manner allows a single process system 42 to be used to manufacture tie articles of the present disclosure having a variety of customized bib portions, where the only modification to process system 42 is to interchange the cutting die 56.

EXAMPLES

The present disclosure is more particularly described in the following examples that are intended as illustrations only, since numerous modifications and variations within the scope of the present disclosure will be apparent to those skilled in the art.

Sample bib ties of Runs 1-7 were prepared and tested with a Twist Strength Test to compare the effects of the perforations in the arms. Each bib tie included a paper-based sheet with a wire assembly adhered to the rear surface. The bib tie of Run 1 did not include any perforations, and each arm had a width of 0.25 inches (along direction 20*c*). In comparison, the bib ties for Runs 2-7 included perforations extending from the distal end of each arm towered the mid-segment for a distance of 2-inches, where pairs of perforations were offset from each other by 0.25 inches (similar to that shown in FIGS. 2-5B). Additionally, each arm in Runs 2-7 had a width of 0.5 inches (along direction 20*c*). Table 1 illustrates the materials used for the wire assemblies for each bib tie.

TABLE 1

| Run | Perforations? | Bib Tie Wire Assembly |
|---|---|---|
| Run 1 | No | Paper sheet, with clear front film |
| Run 2 | Yes | GT1 4-mil, All Plastic Tie |
| Run 3 | Yes | GT1 4-mil, Paper Plastic Tie |
| Run 4 | Yes | Paper Plastic Tie, Wet Strength Paper, Overlamination |
| Run 5 | Yes | Paper Plastic Tie, Wet Strength Paper, Varnish |
| Run 6 | Yes | Plastic Tie, Wet Strength Paper, Overlamination |
| Run 7 | Yes | Plastic Tie, Wet Strength Paper, Varnish |

For the Twist Strength Test, a bib tie is tied around a steel cylinder of fixed diameter. The tie is looped around, held crossed in one hand (but not twisted yet), and then the cylinder is rotated for the desired number of twists (e.g., 360 degrees for one twist). This helps ensure all the twisted ties have the same applied diameter and the twist itself is the same. The twisted tie is then carefully slid off the steel cylinder, and the extra tie is trimmed away from the tie helix (any distal tie portion more than 0.25 inches away from the helix). The twisted tie is then set on two pins of a measurement system ("INSTRON 3345" from Instron Corporation, Norwood, Mass.).

The two pins are vertically in line with each other. The bottom pin is held steady, and the top pin is attached to a force gauge and very slowly pulled straight upwards and away from the bottom pin. The measurement system measures the force on the gauge as it slowly pulls on the helix, and the tensile strength results are recorded in pounds. The maximum load is the number of pounds required to start pulling the helix apart, and the average load is the number of pounds applied while the system is pulling the helix apart. A higher value corresponds to better twist-retention properties. Tables 2-4 show the mean values for the maximum and average loads for the Twist Strength Tests, for one twist, two twists, and three twists, respectively.

TABLE 2

(One Twist - 360 Degrees)

| Run | Maximum load | Average Load |
|---|---|---|
| Run 1 | 6.06 | 2.92 |
| Run 2 | 6.53 | 2.99 |
| Run 3 | 7.31 | 3.15 |
| Run 4 | 8.06 | 4.56 |
| Run 5 | 8.58 | 4.37 |
| Run 6 | 6.51 | 3.64 |
| Run 7 | 7.53 | 3.38 |

TABLE 3

(Two Twists - 720 Degrees)

| Run | Maximum load | Average Load |
|---|---|---|
| Run 1 | 12.53 | 7.50 |
| Run 2 | 12.27 | 6.84 |
| Run 3 | 17.07 | 9.66 |
| Run 4 | 11.49 | 8.37 |
| Run 5 | 15.58 | 9.40 |
| Run 6 | 10.93 | 7.86 |
| Run 7 | 11.15 | 7.52 |

TABLE 4

(Three Twists - 1080 Degrees)

| Run | Maximum load | Average Load |
|---|---|---|
| Run 1 | 13.71 | 9.87 |
| Run 2 | 16.31 | 11.18 |
| Run 3 | 20.18 | 12.42 |
| Run 4 | 14.03 | 10.51 |
| Run 5 | 18.02 | 12.13 |
| Run 6 | 12.21 | 9.10 |
| Run 7 | 12.13 | 9.39 |

Although the present disclosure has been described with reference to several embodiments, workers skilled in the art will recognize that changes may be made in form and detail without departing from the spirit and scope of the disclosure.

What is claimed is:

1. A labelling tie, including:

a tie portion including:

a first arm having a first edge extending lengthwise along the first arm;

a mid-segment; and a second arm having a second edge extending lengthwise along the second arm; wherein a plurality of spaced apart perforations intersects each of the first and second edges; and wherein at least one of the plurality of perforations includes a plurality of slots separated by one or more connecting tabs;

a wire assembly including a retention wire, wherein the retention wire spans across the first arm, the mid-segment, and the second arm; and a bib portion connected to the tie portion.

2. The labelling tie of claim 1, wherein the bib portion is integrally formed with the mid-segment.

3. The labelling tie of claim 1, wherein the first arm and the second arm extend in opposing directions from the mid-segment.

4. The labelling tie of claim 1, wherein the plurality of perforations are positioned proximate distal ends of the respective first and second arms.

5. The labelling tie of claim 1, wherein at least one of the plurality of perforations is cut substantially perpendicularly to the retention wire.

6. The labelling tie of claim 1, wherein at least one of the plurality of perforations on each of the first and second arms is configured to separate when the first and second arms are twisted together;

wherein the plurality of perforations define a plurality of first arm segments on the first arm and a plurality of second arm segments on the second arm; and wherein at least a first arm segment and at least a second arm segment are configured to interlock to secure the arms together.

7. The labelling tie of claim 1, further including printed indicia provided on the bib portion.

8. The labelling tie of claim 1, wherein the wire assembly further includes a sleeve that encases the retention wire.

9. The labelling tie of claim 1, further including an adhesive layer disposed between the wire assembly and the tie portion.

10. The labelling tie of claim 1, wherein the tie portion and the wire assembly are secured through heat bonding.

11. A sheet of labelling ties, including:

a plurality of separably connected labelling ties, wherein each labelling tie includes:

a tie portion including a first arm having a first edge extending lengthwise along the first arm, a mid-segment, and a second arm having a second edge extending lengthwise along the second arm, and wherein each of the first arm and second arm includes spaced apart perforations intersecting each of the first and second edges, wherein at least one of the perforations includes a plurality of slots separated by one or more connecting tabs;

a wire assembly including a retention wire, wherein the retention wire spans across the first arm, the mid-segment, and the second arm; and a bib portion integrally formed with the tie portion.

12. The sheet of claim 11 wherein at least two of the plurality of labelling ties are laid out such that their respective tie portions are arranged longitudinally along a line to form a first row of labelling ties.

13. The sheet of claim 12 further comprising at least a second row of labelling ties;

wherein the second row of labelling ties is arranged such that a bib portion of the second row is disposed between two adjacent bib portions of the first row;

wherein each bib portion of the second row is oriented to be upside-down relative to each bib portion of the first row; and wherein the first and second rows of labelling ties form a first pair of rows.

14. The sheet of claim 13 further comprising at least a second pair of rows disposed to lie parallel to the first pair.

15. A method of using a labelling tie, the labelling tie including:

a tie portion including a first arm having a first edge extending lengthwise along the first arm, a mid-segment, and a second arm having a second edge extending lengthwise along the second arm, and wherein a plurality of spaced apart perforations intersects each of the first and second edges thereby defining arm segments, wherein at least one of the perforations includes a plurality of slots separated by one or more connecting tabs;

a wire assembly including a retention wire, wherein the retention wire spans across the first arm, the mid-segment, and the second arm; and a bib portion connected to the tie portion;

the method including:

wrapping the first arm around a first side of at least one object;

wrapping the second arm around a second side of the at least one object such that the first arm and the second arm meet at a location, wherein a portion of the first arm and a portion of the second arm extend past the location; and twisting the first arm portion and second arm portion together to break at least one of the connecting tabs such that the tie portion and thus the bib portion are secured about the at least one object.

16. The method of claim 15 wherein twisting the first and second arm portions together includes interlocking at least one of the first arm segments with at least one of the second arm segments to further secure the tie portion about the at least one object.

* * * * *